US008302393B2

(12) United States Patent
Ambrosino et al.

(10) Patent No.: US 8,302,393 B2
(45) Date of Patent: Nov. 6, 2012

(54) EXHAUST SYSTEM OF AN INTERNAL COMBUSTION ENGINE

(75) Inventors: Massimo Ambrosino, Ivrea (IT); Luigi Lubrano, Novara (IT); Pompilio Giorgi, Turin (IT); Matteo Sbarile, Cascine Vica Rivoli (IT); Francesco Sciacca, Turin (IT)

(73) Assignee: Magneti Marelli S.p.A., Corbetta (IT)

( * ) Notice: Subject to any disclaimer, the term of this patent is extended or adjusted under 35 U.S.C. 154(b) by 430 days.

(21) Appl. No.: 12/637,834

(22) Filed: Dec. 15, 2009

(65) Prior Publication Data

US 2010/0146957 A1 Jun. 17, 2010

(30) Foreign Application Priority Data

Dec. 17, 2008 (EP) ..... 08425799

(51) Int. Cl.
*F01N 1/00* (2006.01)

(52) U.S. Cl. ..... 60/324; 60/322; 181/241; 181/253; 181/254

(58) Field of Classification Search ..... 60/274, 60/284–286, 322–324; 181/226, 222, 256, 181/254
See application file for complete search history.

(56) References Cited

U.S. PATENT DOCUMENTS

| | | | | |
|---|---|---|---|---|
| 3,908,366 | A * | 9/1975 | Masaki | 60/277 |
| 3,965,677 | A * | 6/1976 | Goto et al. | 60/277 |
| 4,926,636 | A * | 5/1990 | Tadokoro et al. | 60/312 |
| 5,305,787 | A * | 4/1994 | Thygesen | 137/527 |
| 5,392,812 | A * | 2/1995 | Herron | 137/527.8 |
| 5,744,762 | A * | 4/1998 | Seki et al. | 181/254 |
| 5,959,263 | A * | 9/1999 | Foltz, Jr. | 181/254 |
| 5,971,098 | A | 10/1999 | Suzuki et al. | |
| 6,598,390 | B2 * | 7/2003 | Chang | 60/323 |
| 6,662,554 | B2 * | 12/2003 | Sheidler et al. | 60/290 |
| 6,708,798 | B2 * | 3/2004 | Chang | 181/226 |
| 2005/0257517 | A1 * | 11/2005 | Lavin | 60/288 |
| 2006/0137330 | A1 * | 6/2006 | I et al. | 60/288 |
| 2008/0223025 | A1 * | 9/2008 | Hill | 60/324 |
| 2009/0127023 | A1 * | 5/2009 | Abram et al. | 181/232 |

FOREIGN PATENT DOCUMENTS

| | | | |
|---|---|---|---|
| EP | 0721059 | A | 7/1996 |
| FR | 2841595 | A | 1/2004 |
| WO | 2008/115212 | A | 9/2008 |

OTHER PUBLICATIONS

European Search Report in corresponding EP Application No. 08425799, dated Jul. 21, 2009.

* cited by examiner

*Primary Examiner* — Thomas Denion
*Assistant Examiner* — Jesse Bogue
(74) *Attorney, Agent, or Firm* — Manelli Selter PLLC; Edward J. Stemberger

(57) ABSTRACT

An exhaust system of an internal combustion engine and provided with: at least one first high acoustic attenuation path having a first inlet opening; at least one second low acoustic attenuation path having a second inlet opening; and at least one control valve, which is arranged at the second inlet opening of the second path to control the flow of the exhaust gases along the second path.

19 Claims, 3 Drawing Sheets

EXHAUST SYSTEM OF AN INTERNAL COMBUSTION ENGINE

TECHNICAL FIELD

The present invention relates to an exhaust system of an internal combustion engine.

BACKGROUND ART

An internal combustion engine is provided with an exhaust system, which serves the function of introducing the gases produced by the combustion into the atmosphere, thus limiting both the noise and the content of pollutants. A modern exhaust system comprises at least one muffler, which typically has an elliptical section and is provided with at least one inlet opening and at least one outlet opening. A labyrinth which determines a path for the exhaust gases from the inlet opening to the outlet opening is defined within the muffler; such a labyrinth is normally formed by diaphragms (or baffles), transversally or longitudinally arranged to define chambers, and (possibly laterally perforated) pipes which connect the chambers to one another.

The back pressure generated by the muffler (i.e. the pressure loss determined in the exhaust gases passing through the muffler) exponentially grows as the engine speed (revolutions) increases (i.e. as the average speed of the exhaust gases increases). Accordingly, fuel consumption and direct $CO_2$ emissions are penalized due to the back pressure generated by the muffling body in order to reduce noise emissions. To obviate this drawback, it has been suggested to construct an exhaust system (e.g. described in U.S. Pat. No. 5,301,503A1) with two differentiated paths according to the engine speed, so that at low speeds (low exhaust gas pressure) the exhaust gases follow a first high acoustic attenuation (i.e. high back pressure) path, while at high speeds (high exhaust gas pressure), the exhaust gases follow a second low acoustic attenuation (i.e. low back pressure) path. In an exhaust system with two differentiated paths, a control valve is provided, which is adapted to alternatively direct the exhaust gases along the desired path according to the engine speed. These control valves usually include the use of an electric, electro-pneumatic or similar actuator, which is driven by an electronic control unit of the engine to move the position of one or more baffles which direct the exhaust gases into the exhaust system.

It has been observed that the reliability of the control valves is restricted over time; in fact, because of mechanical and thermal stresses typical of the exhaust systems, and due to scaling formed by the exhaust gases, the known control valves tend to stick or in any case they work in a manner other than that envisaged in the step of designing. Furthermore, due to the presence of an electric or electro-pneumatic actuator, the known control valves are heavy and large in size (also because the electric or electro-pneumatic actuator needs to be thermally and mechanically protected) and their cost is considerably high (also because of the need to provide the wiring/electro-pneumatic connection of the electric/electro-pneumatic actuator in a region of the vehicle which undergoes considerable heating and is exposed to the road surface).

DISCLOSURE OF INVENTION

It is the object of the present invention to provide an exhaust system of an internal combustion engine, which exhaust system is free from the above described drawbacks, and specifically, which is easy and cost-effective to be manufactured and which may be installed in "aftermarket" situations (once the vehicle has been purchased).

According to the present invention, an exhaust system of an internal combustion engine is provided as claimed in the attached claims.

BRIEF DESCRIPTION OF THE DRAWINGS

The present invention will now be described with reference to the accompanying drawings, which illustrate some non-limitative embodiments thereof, in which.

PREFERRED EMBODIMENTS OF THE INVENTION

Figure 1:
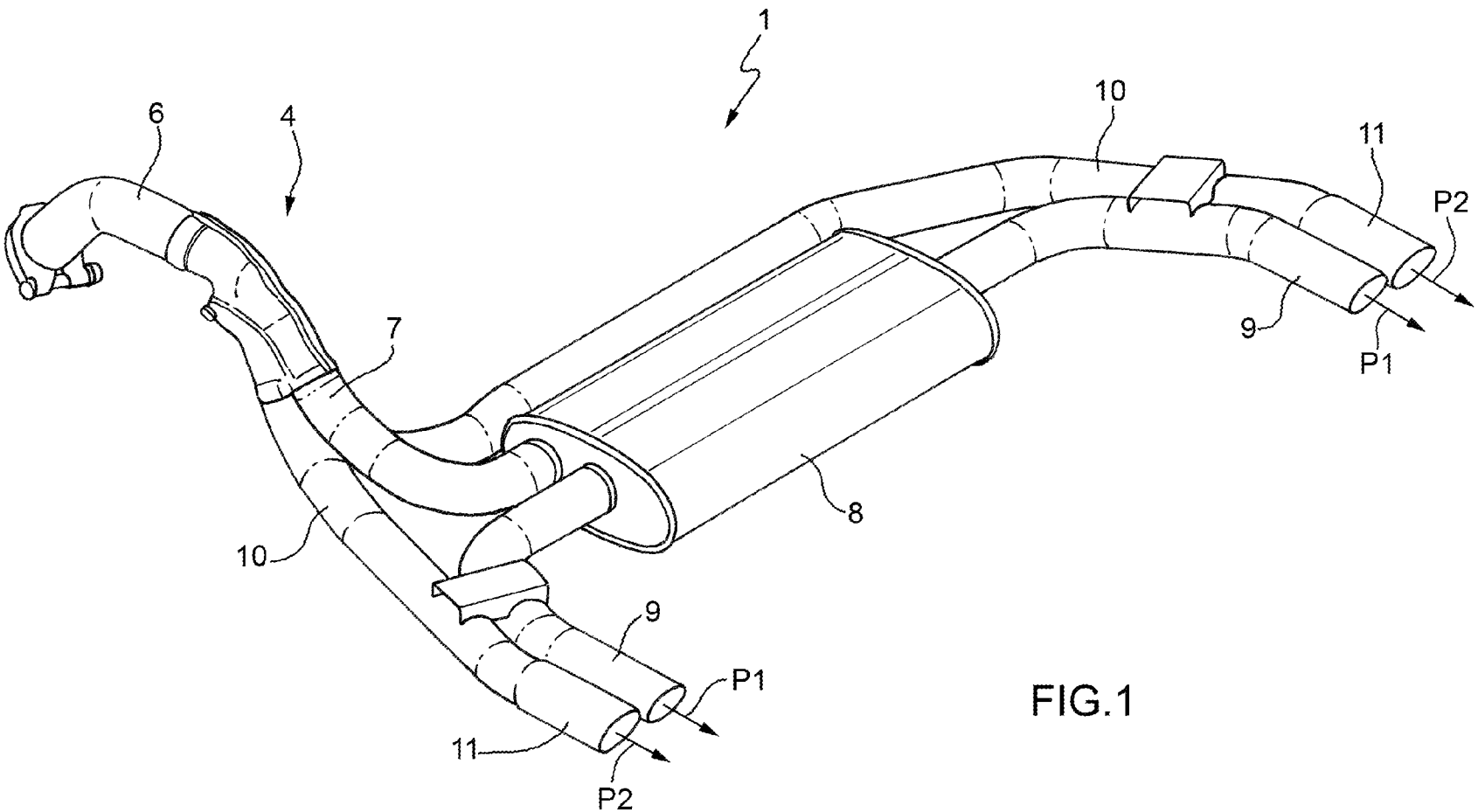
FIG. 1 is a diagrammatic, perspective view of an exhaust system made according to the present invention.

In FIG. 1, numeral 1 indicates as a whole an exhaust system of an internal combustion engine (not shown).

System 1 comprises a high acoustic attenuation (thus, high back pressure) path P1, having an inlet opening 2 (shown in FIG. 2), a low acoustic attenuation (thus, low back pressure) path P2, having an inlet opening 3 (shown in FIG. 2), and a control valve 4 which is arranged at the inlet opening 3 of the path P2 to control the flow of the exhaust gases along the path P2. In other words, the control valve 4 directly controls the flow of the exhaust gases along the path P2 by opening or closing the inlet opening 3 of the path P2, and therefore indirectly controls the flow of the exhaust gases along the path P1 because, when the inlet opening 3 of the path P2 is closed, the exhaust gases must mandatorily flow along the path P1, while when the inlet opening 3 of the path P2 is open, the exhaust gases tend to flow along the path P2 and not along the path P1 due to the lower back pressure in path P2.

Figure 2:
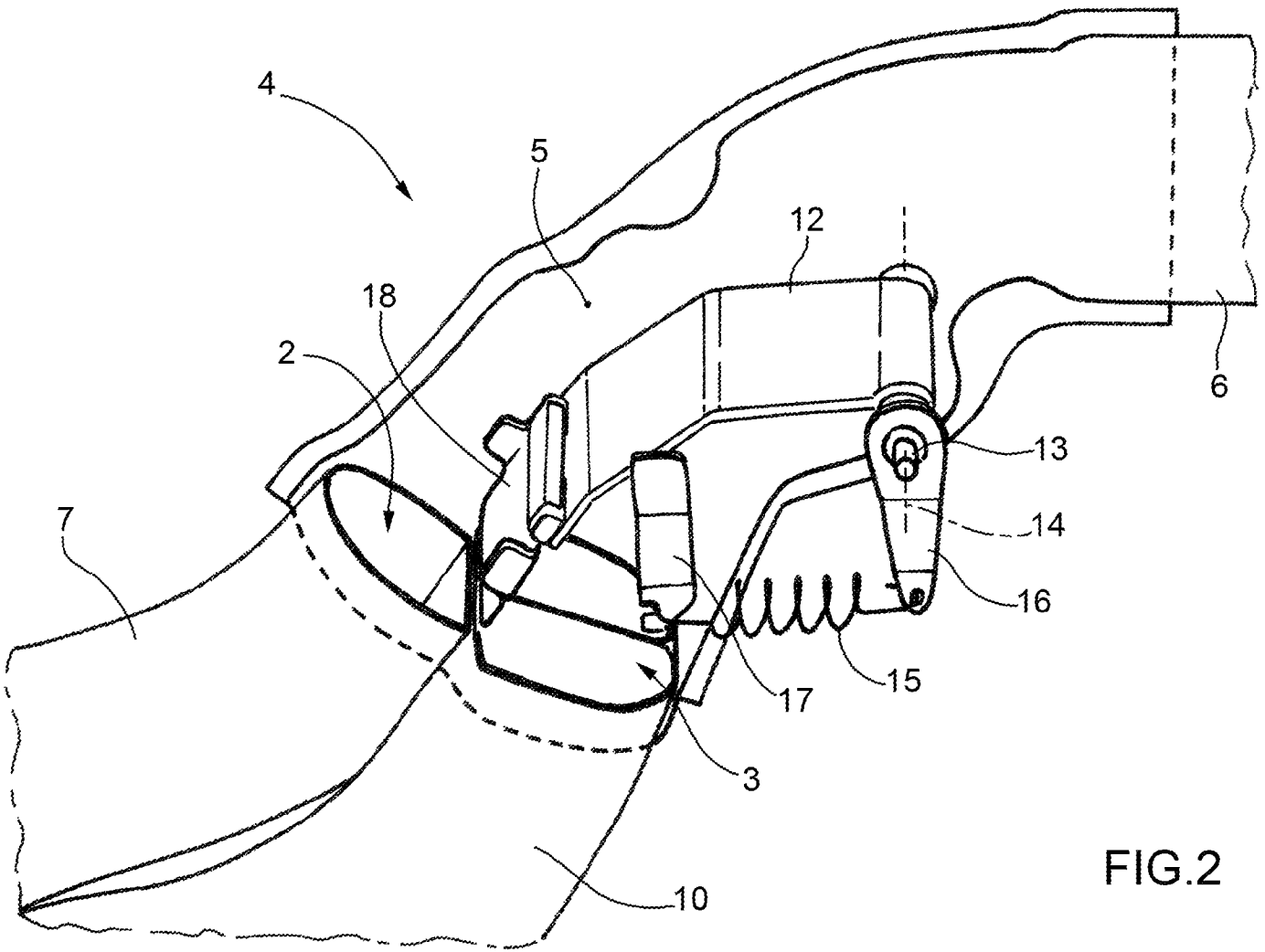
FIG. 2 is a diagrammatic, perspective view with parts removed for clarity of a control valve of the exhaust system in FIG. 1.

The exhaust valve 4 comprises a chamber 5, which is defined by a body formed by joining two substantially mirror-like half-shells (only one of which is shown in FIG. 2). A connecting pipe 6, which receives the exhaust gases from an exhaust line of the internal combustion engine (not shown), typically provided with devices (catalyzer, particulate filter, etc.) for reducing the polluting emissions, leads into the chamber 5. A connecting pipe 7, which leads into a muffler 8 and along with the muffler 8 forms part of the path P1, departs from the chamber 5; furthermore, path P1 comprises a pair of tails 9 which originate from the muffler 8 and are arranged on opposite sides of the muffler 8. Two connecting pipes 10, which end in two tails 11 and along with the same tails 11 define the path P2, depart from the chamber 5. Each tail 11 is preferably arranged by the side of a corresponding tail 9, so that the four tails 9 and 11 are grouped in pairs. According to a different embodiment shown in FIG. 3, path P2 comprises a single connecting pipe 10 which ends in a single tail 11.

In other words, from the above, it is apparent that the high attenuation path P1 comprises the muffler 8, while the low acoustic attenuation path P2 is free from elements or paths suitable for acoustic muffling.

As shown in FIG. 2, the control valve 4 comprises a movable baffle 12, which is arranged inside the chamber 5 and, in a closing position (shown in FIG. 2) of the inlet opening 3 of the low attenuation path P2, it forms a wall of an exhaust gas passage pipe; in other words, inside the chamber 5, the baffle 12 arranged in the closing position (shown in FIG. 2) forms a baffle which prevents the exhaust gases from entering the low acoustic attenuation path P2, and directs the exhaust gases to the high acoustic attenuation path P1. Furthermore, the control valve 4 comprises a shaft 13 which is mounted to rotate about a rotation axis 14 and supports the baffle 12 in order to rotate the baffle 12 itself between the closing position (shown in FIG. 2) of the opening inlet 3 and an opening position (not shown) of the inlet opening 3. According to a preferred embodiment, the shaft 13 is keyed onto one end of the baffle 12 arranged upstream with respect to the flow direction of the exhaust gases.

The control valves 4 finally comprises an elastic body 15 which is mechanically coupled to the shaft 13 to push the baffle 12 towards the closing position with an elastic force calibrated according to the area of the baffle 12 hit by the exhaust gases and to the working pressure of the exhaust gases so that when the exhaust gas pressure exceeds a predetermined threshold value, the pneumatically originated force generated by the pressure of the exhaust gases on the baffle 12 is higher than the elastic force generated by the elastic body 15, and the baffle 12 moves towards the opening position. In other words, when the baffle 12 is in the closing position, the exhaust gas having a pressure higher than atmospheric pressure is on one side of the baffle 12, while atmospheric pressure substantially exists on the side of the baffle 12; this pressure differential determines a pneumatically originated force which tends to open the control valve 4, i.e. which tends to push the baffle 12 towards the opening position, against the elastic bias generated by the elastic body 15. As the speed of the internal combustion engine increases, the pressure of the exhaust gases increases, and therefore the pneumatically originated force generated by the exhaust gas pressure on the baffle 12 also increases; by appropriately calibrating the elastic force generated by the elastic body 15, the opening of the control valve 4, i.e. the displacement of the baffle 12 to the opening position, may be determined when the pressure of the exhaust gases exceeds a first predetermined threshold value, i.e. when the speed of the internal combustion engine exceeds a corresponding second, predetermined threshold value.

According to a preferred embodiment, the shaft 13 of the control valve 4 has an external end, which protrudes outside the exhaust gas passage pipe (i.e. outside the chamber 5), and is mechanically coupled to the elastic body 15. The control valve 4 comprises a pivoting lever 16 which is arranged outside the exhaust gas passage pipe (i.e. outside the chamber 5), is keyed onto the external end of the shaft 13, and is mechanically coupled to the elastic body 15. Furthermore, the control valve 4 comprises a fixed arm 17, which is secured to an external wall of the exhaust gas passage pipe and receives a second end of the elastic body 15, while a first end of the elastic body 15 is integral with the pivoting lever 16. According to a preferred embodiment, the elastic body 15 is a spiral spring which connects the pivoting lever 16 to the fixed arm 17.

According to a preferred embodiment, the control valve 4 comprises a limit stop 18, which defines the closing position and forms a wall of an exhaust gas passage pipe which is arranged inside the chamber 5.

Two initial ends of the two connecting pipes 10 are arranged reciprocally side-by-side within the chamber 5 of the control valve 4, and form the inlet opening 3 of the low acoustic attenuation path P2. The connecting pipe 7 has a final end which leads into the muffler 8 and an initial end which is arranged inside the chamber 5 of the control valve 4 over the initial ends of the two connecting pipes 10 and forms the inlet opening 2 of the first high acoustic attenuation path P1. In the closing position, one free end of the baffle 12 opposite to the end integral with the shaft 13 is aligned with a separation line between the initial ends of the two connecting pipes 10 and the initial end of the connecting pipe 7. The connecting pipe 6 connects the chamber 5 of the control valve 4 to the exhaust line of the internal combustion engine and leads into the chamber 5 on the side opposite to the baffle 12 of the initial ends of the connecting pipes 7 and 10.

Figure 3:
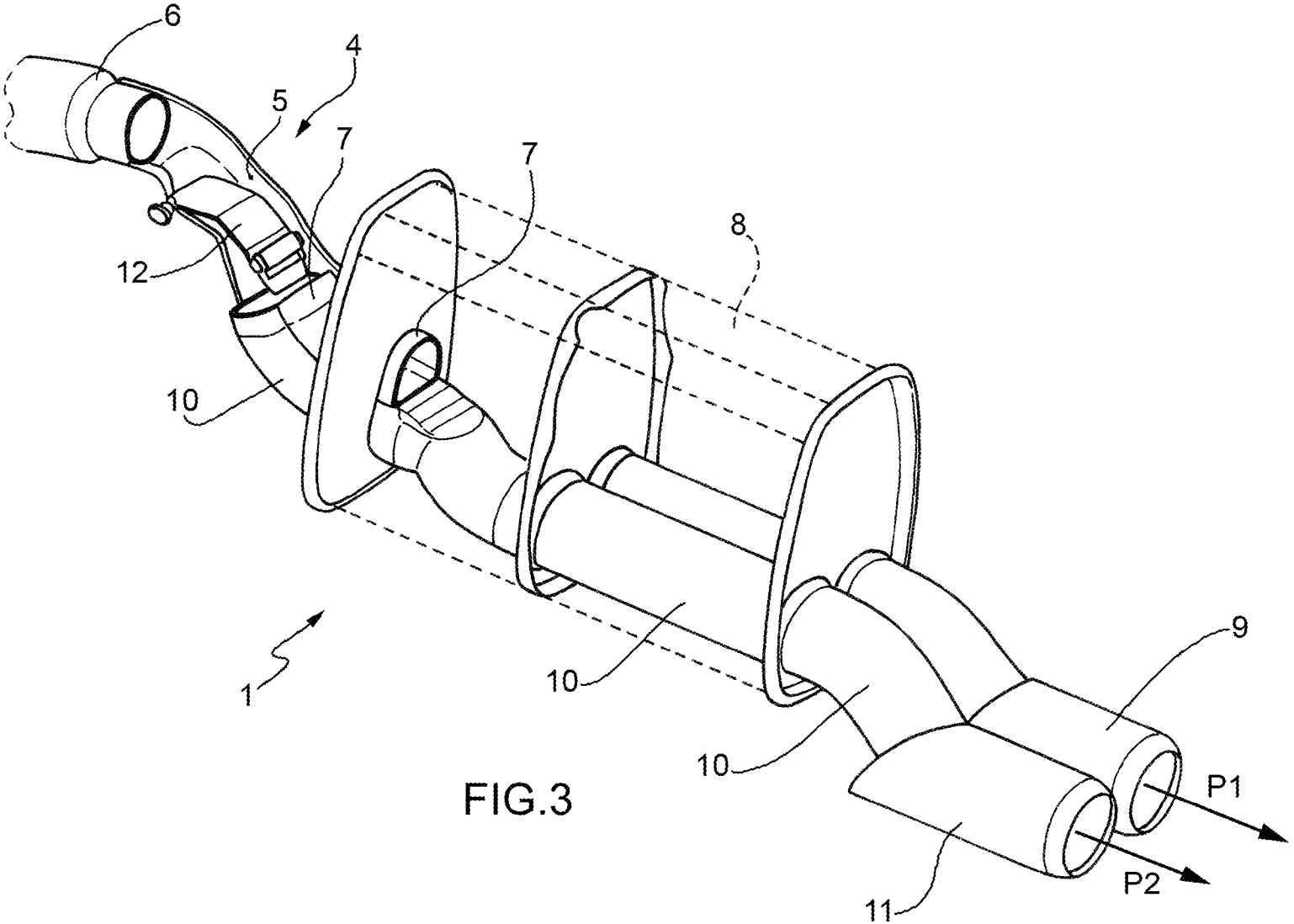
FIG. 3 is a diagrammatic, perspective view of a further exhaust system made according to the present invention.

According to a different embodiment shown in FIG. 3, the path P2 comprises a single connecting pipe 10 ending in a single tail 11, and the path P1 comprises a single tail 9 protruding from the muffler 8; in this embodiment, the connecting pipe 10 which connects the chamber 5 of the control valve 4 to the tail 11 preferably passes through the muffler 8. In other words, the connecting pipe 10 crosses the muffler 8 and has no communication with the muffler 8 itself; thereby the connecting pipe 10 is mechanically supported by the muffler 8, but has no functional relationship with the muffler 8 itself.

The above-described exhaust system 1 has many advantages, because it is simple and cost-effective to be manufactured while being very reliable over time; this result is reached in virtue of the fact that the mechanism for actuating the control valve 4 is completely mechanical and thus free from electric actuators and has the elastic body 15 arranged inside the chamber 5 (and therefore is not concerned by the exhaust gases and not subject to scaling formed by the exhaust gases). Furthermore, in virtue of the conformation of the baffle 12, the control valve 4 has very low load losses and thus does not negatively affect the performance of the internal combustion engine.

The invention claimed is:

1. An exhaust system (1) for an internal combustion engine and comprising:

at least one first high acoustic attenuation path (P1) having a first inlet opening (2) and comprising a muffler (8);

at least one second low acoustic attenuation path (P2) having a second inlet opening (3) and being free from elements or paths suitable for acoustic muffling; and at least one control valve (4), which is arranged at the second inlet opening (3) of the second path (P2) for controlling the flow of the exhaust gases along the second path (P2), wherein the control valve (4) comprises:

a baffle (12) which forms a wall of an exhaust gas passage pipe when is in a closing position of the second inlet opening (3);

a shaft (13) which is mounted to rotate about a rotation axis (14) and supports the baffle (12) in order to rotate the baffle (12) itself between the closing position of the second inlet opening (3) and an opening position of the second inlet opening (3); and an elastic body (15), which is mechanically coupled to the shaft (13) to push the baffle (12) towards the closing position with an elastic force calibrated according to the area of the baffle (12) struck by the exhaust gases and to the working pressure of the exhaust gases, so that when the exhaust gas pressure exceeds a predetermined threshold value, the pneumatically originated force generated by the pressure of the exhaust gases on the baffle (12) is higher than the elastic force generated by the elastic body (15) and the baffle (12) moves to the opening position; and wherein the first path (P1) comprises at least one first tail (9), which originates from the muffler (8); the second path (P2) comprises at least one second tail (11), which is arranged by the side of the first tail (9) and is directly connected to the second inlet opening (3) by means of a first connecting pipe (10); the control valve (4) comprises a chamber (5) in which the baffle (12) is accommodated; and an initial end of the first connecting pipe (10) is arranged inside the chamber (5) of the control valve (4) and forms the second inlet opening (3) of the second path (P2).

2. An exhaust system (1) according to claim 1, wherein the shaft (13) which is keyed onto one end of the baffle (12), is arranged upstream with respect to the flow direction of the exhaust gases.

3. An exhaust system (1) according to claim 1, wherein the shaft (13) of the control valve (4) has an external end which protrudes outside the exhaust gas passage pipe and is mechanically coupled to the elastic body (15).

4. An exhaust system (1) according to claim 3, wherein the control valve (4) comprises a pivoting lever (16), which is arranged outside the exhaust gas passage pipe, is keyed onto the external end of the shaft (13), and is mechanically coupled to the elastic body (15).

5. An exhaust system (1) according to claim 4, wherein the elastic body (15) is a spiral spring having a first end integral with the pivoting lever (16) and a second end integral with a fixed point.

6. An exhaust system (1) according to claim 5, wherein the control valve (4) comprises a fixed arm (17), which is secured to a wall of the exhaust gas passage pipe and receives the second end of the elastic body (15).

7. An exhaust system (1) according to claim 1, wherein the control valve (4) comprises a limit stop (18), which defines the closing position and forms a wall of an exhaust gas passage pipe.

8. An exhaust system (1) according to claim 1, wherein the first path (P1) comprises a pair of first tails (9), which originate from the muffler (8) and are arranged on opposite sides of the muffler (8), and the second path (P2) comprises a pair of second tails (11), each of which is arranged by the side of a first tail (9) and is directly connected to the second inlet opening (3) by means of a first connecting pipe (10).

9. An exhaust system (1) according to claim 8, wherein the control valve (4) comprises a chamber (5) wherein the baffle (12) is accommodated; two initial ends of the first two connecting pipes (10) are arranged reciprocally side-by-side within the chamber (5) of the control valve (4) and form the second inlet opening (3) the second path (P2).

10. An exhaust system (1) according to claim 9, and comprising a second connecting pipe (7) which has a final end leading into the muffler (8), and an initial end which is arranged inside the chamber (5) of the control valve (4) over the initial ends of the first two connecting pipes (10) and forms the first inlet opening (2) of the first path (P1).

11. An exhaust system (1) according to claim 10, wherein in the closing position, one free end of the baffle (12), opposite to the end integral with the shaft (13), is aligned with a separation line between the initial ends of the two first connecting pipes (10) and the initial end of the second connecting pipe (7).

12. An exhaust system (1) according to claim 1, and comprising a second connecting pipe (7) which has a final end which leads into the muffler (8), and an initial end which is arranged inside the chamber (5) of the control valve (4) over the initial end of the first connecting pipe (10) and forms the first inlet opening (2) of the first path (P1); in the closing position, a free end of the baffle (12), opposite to the end integral with the shaft (13), is aligned with a separation line between the initial end of the first connecting pipe (10) and the initial end of the second connecting pipe (7).

13. An exhaust system (1) according to claim 1, wherein the first connecting pipe (10) passes through the muffler (8) to be mechanically supported by the muffler (8) without any functional relationship with the muffler (8) itself.

14. An exhaust system (1) according to claim 9, and comprising a first connecting pipe (6) which connects the chamber (5) of the control valve (4) to an exhaust line of the internal combustion engine and leads into the chamber (5) at the side opposite to the baffle (12) of the initial ends of the first and second connecting pipes (10, 7).

15. An exhaust system (1) for an internal combustion engine and comprising:

at least one first high acoustic attenuation path (P1) having a first inlet opening (2) and comprising a muffler (8);

at least one second low acoustic attenuation path (P2) having a second inlet opening (3) and being free from elements or paths suitable for acoustic muffling; and at least one control valve (4), which is arranged at the second inlet opening (3) of the second path (P2) for controlling the flow of the exhaust gases along the second path (P2), wherein the control valve (4) comprises:

a baffle (12) which forms a wall of an exhaust gas passage pipe when is in a closing position of the second inlet opening (3);

a shaft (13) which is mounted to rotate about a rotation axis (14) and supports the baffle (12) in order to rotate the baffle (12) itself between the closing position of the second inlet opening (3) and an opening position of the second inlet opening (3); and an elastic body (15), which is mechanically coupled to the shaft (13) to push the baffle (12) towards the closing position with an elastic force calibrated according to the area of the baffle (12) struck by the exhaust gases and to the working pressure of the exhaust gases, so that when the exhaust gas pressure exceeds a predetermined threshold value, the pneumatically originated force generated by the pressure of the exhaust gases on the baffle (12) is higher than the elastic force generated by the elastic body (15) and the baffle (12) moves to the opening position;

wherein the first path (P1) comprises a pair of first tails (9), which originate from the muffler (8) and are arranged on opposite sides of the muffler (8), and the second path (P2) comprises a pair of second tails (11), each of which is arranged by the side of a first tail (9) and is directly connected to the second inlet opening (3) by means of a first connecting pipe (10).

16. An exhaust system (1) according to claim 15, wherein the control valve (4) comprises a chamber (5) wherein the baffle (12) is accommodated; two initial ends of the first two connecting pipes (10) are arranged reciprocally side-by-side within the chamber (5) of the control valve (4) and form the second inlet opening (3) the second path (P2).

17. An exhaust system (1) according to claim 16, and comprising a second connecting pipe (7) which has a final end leading into the muffler (8), and an initial end which is arranged inside the chamber (5) of the control valve (4) over the initial ends of the first two connecting pipes (10) and forms the first inlet opening (2) of the first path (P1).

18. An exhaust system (1) according to claim 17, wherein in the closing position, one free end of the baffle (12), opposite to the end integral with the shaft (13), is aligned with a separation line between the initial ends of the two first connecting pipes (10) and the initial end of the second connecting pipe (7).

19. An exhaust system (1) according to claim 16, and comprising a first connecting pipe (6) which connects the chamber (5) of the control valve (4) to an exhaust line of the internal combustion engine and leads into the chamber (5) at the side opposite to the baffle (12) of the initial ends of the first and second connecting pipes (10, 7).

* * * * *